US010129963B2

(12) United States Patent
Yamauchi et al.

(10) Patent No.: US 10,129,963 B2
(45) Date of Patent: Nov. 13, 2018

(54) LIGHTING SYSTEM, LIGHTING DEVICES, AND TERMINAL

(71) Applicant: Panasonic Intellectual Property Management Co., Ltd., Osaka (JP)

(72) Inventors: Kentaro Yamauchi, Hyogo (JP); Saori Ueno, Osaka (JP); Sana Yagi, Osaka (JP); Shinsuke Nishioka, Osaka (JP); Natsuka Nakauchi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 7 days.

(21) Appl. No.: 15/453,196

(22) Filed: Mar. 8, 2017

(65) Prior Publication Data

US 2017/0265284 A1 Sep. 14, 2017

(30) Foreign Application Priority Data

Mar. 10, 2016 (JP) ..... 2016-047388

(51) Int. Cl.
*H05B 37/02* (2006.01)
*H05B 33/08* (2006.01)
*G08C 17/02* (2006.01)

(52) U.S. Cl.
CPC ..... *H05B 37/0272* (2013.01); *H05B 33/0842* (2013.01); *G08C 17/02* (2013.01)

(58) Field of Classification Search
CPC ..... H05B 37/0272; H05B 37/0245; H05B 37/029; H05B 37/02; H05B 33/0863;
(Continued)

(56) References Cited

U.S. PATENT DOCUMENTS 8,598,978 B2 * 12/2013 Knode ..... H05B 37/0272 340/12.23
9,268,004 B2 * 2/2016 Kusakari ..... G01S 1/08
(Continued)

FOREIGN PATENT DOCUMENTS

JP 2004-265774 A 9/2004
JP 2006-092917 A 4/2006
(Continued)

*Primary Examiner* — Tung X Le
*Assistant Examiner* — Borna Alaeddini
(74) *Attorney, Agent, or Firm* — McDermott Will & Emery LLP

(57) ABSTRACT

A lighting system includes lighting devices and a terminal. The terminal includes a display screen, an input unit, a wireless transmitter which transmits a radio signal, a communication unit which wirelessly transmits a control command to one of a communication address and a logical address for at least one of the lighting devices, specifying the one of the communication address and the logical address, and a controller which displays, on the display screen, icons respectively corresponding the lighting devices, and when an instruction for selecting any one of the icons has been received by the input unit, causes the wireless transmitter to transmit a radio signal indicating predetermined information. When one of the lighting devices which corresponds to the selected icon has received the radio signal, the lighting device transmits the communication address assigned to the lighting device itself to be used for communication with the communication unit.

18 Claims, 14 Drawing Sheets

(58) Field of Classification Search
CPC ... H05B 37/0254; G06F 3/04842; G06F 3/00; G06F 3/048
See application file for complete search history.

(56) References Cited

U.S. PATENT DOCUMENTS

| | | | | |
|---|---|---|---|---|
| 9,523,757 | B2 * | 12/2016 | Fukuda | G01S 1/02 |
| 9,713,231 | B2 * | 7/2017 | Kelly | G08C 17/02 |
| 2014/0070707 | A1 * | 3/2014 | Nagazoe | H04B 10/116 315/151 |
| 2014/0265863 | A1 * | 9/2014 | Gajurel | H05B 37/02 315/131 |
| 2014/0265881 | A1 * | 9/2014 | Karc | H05B 37/0272 315/158 |
| 2015/0005900 | A1 * | 1/2015 | Steele | G05B 15/02 700/19 |
| 2015/0195891 | A1 * | 7/2015 | Ku | H05B 37/02 315/131 |

FOREIGN PATENT DOCUMENTS

| | | | |
|---|---|---|---|
| JP | 2006-093098 | A | 4/2006 |
| JP | 2007-042418 | A | 2/2007 |
| JP | 2014-056670 | A | 3/2014 |

* cited by examiner

LIGHTING SYSTEM, LIGHTING DEVICES, AND TERMINAL

CROSS REFERENCE TO RELATED APPLICATION

This application claims the benefit of priority of Japanese Patent Application Number 2016-047388 filed on Mar. 10, 2016, the entire content of which is hereby incorporated by reference.

BACKGROUND

1. Technical Field

The present disclosure relates to a lighting system including a plurality of lighting devices and a terminal which controls the plurality of lighting devices, the lighting devices, and a terminal.

2. Description of the Related Art

In a lighting system including a plurality of lighting devices, mapping of addresses of the plurality of lighting devices (hereinafter simply referred to as "mapping") is required in order for the plurality of lighting devices to be controllable by a terminal such as a tablet terminal transmitting a control command. Mapping is storing information for identifying each of the plurality of lighting devices (hereinafter, this information is referred to as a "logical address") recognized by the terminal and a communication address set in advance in the individual lighting device in order to receive a control command are associated with each other. It is to be noted that the logical address is used not only for identifying each of the plurality of lighting devices in the terminal, but also for identifying the group assigned to the plurality of lighting devices which are targets for which the same control is performed.

Conventionally, various kinds of techniques for mapping in the lighting system including the plurality of lighting devices have been proposed (for example, PTL 1 (Japanese Unexamined Patent Publication No. 2014-56670) etc.

Mapping in the conventional lighting systems including PTL 1 are typically performed according to procedures as indicated below. It is assumed that a plurality of lighting devices and a terminal are connected wirelessly. First, according to an instruction from an operator, the terminal performs, for example, broadcasting to the plurality of lighting devices, so as to obtain the communication addresses of the plurality of lighting devices, and store the communication addresses (perform what is called pairing). Next, the operator selects one (for example, an icon) of the communication addresses of the plurality of lighting devices received just now using the terminal. In response, the terminal transmits a control command for causing a lighting device having the selected communication address to blink toward the lighting device. As a result, the lighting device which has received the control command blinks. The operator checks by eyesight the arrangement position of the blinking lighting device corresponding to the communication address selected just now, and drags the icon of the lighting device to the position on the display screen of the terminal corresponding to the position of the blinking lighting device. The above operations are repeated for all of the lighting devices, so as to complete association (mapping) of each of the plurality of icons (that are logical addresses) corresponding to the arrangement positions of the lighting devices which have been actually arranged and the communication address of the icon. After the completion of the mapping, the terminal transmits a control command to the communication address of the lighting device arranged at a position desired to be controlled, with reference to the result of mapping (the association between the logical address and the communication address), according to the instruction etc. of the operator. In this way, it is possible to control the intended lighting device using the terminal.

SUMMARY

However, in the conventional mapping, when one of the communication addresses of the plurality of lighting devices has been selected, the operator cannot predict which one of the plurality of lighting devices will blink, and thus needs to go to a position near the lighting device which is actually blinking to check the arrangement position of the lighting device. Furthermore the operator needs to repeat this check for each of the plurality of lighting devices. For this reason, when the number of lighting devices included in the lighting system is large, mapping operations require long time, and moreover these operations are extremely troublesome because an operation error may occur when dragging an icon.

The present disclosure was made in view of these circumstances, and has an object to provide a lighting system, lighting devices, and a terminal which make it possible to complete mapping in the lighting system more easily and securely than conventional.

In order to achieve the above object, a lighting system according to an aspect of the present disclosure is a lighting system including: a plurality of lighting devices; and a terminal which controls the plurality of lighting devices, wherein the terminal includes: a display screen; an input unit configured to receive an instruction from an operator; a wireless transmitter which transmits a radio signal having a directivity; a communication unit configured to wirelessly transmit a control command to one of a communication address and a logical address for at least one of the plurality of lighting devices, specifying the one of the communication address and the logical address; and a controller which displays, on the display screen, a plurality of icons respectively corresponding to the plurality of lighting devices, and when an instruction for selecting any one of the plurality of icons has been received by the input unit, causes the wireless transmitter to transmit a radio signal indicating predetermined information, wherein when a lighting device among the plurality of lighting devices, which corresponds to the selected one of the plurality of icons has received the radio signal transmitted from the wireless transmitter, the lighting device transmits the communication address assigned to the lighting device itself to be used for communication with the communication unit.

In order to achieve the above object, the lighting device according to an aspect of the present disclosure is a lighting device in the above lighting system.

In order to achieve the above object, the terminal according to an aspect of the present disclosure is a terminal in the above lighting system.

The present disclosure provides the lighting system, the lighting devices, and the terminal which make it possible to complete mapping in the lighting system more easily and securely than conventional.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Hereinafter, an embodiment of the present disclosure is described in detail with reference to the drawings. Each of the exemplary embodiment and variations described below indicates a general or specific example of the present disclosure. The numerical values, shapes, materials, constituent elements, the arrangement positions and connection of the constituent elements, steps, the processing order of the steps etc. indicated in the following exemplary embodiment and variations are mere examples, and therefore do not limit the scope of the present disclosure. In addition, among the constituent elements in the following exemplary embodiment and variations, constituent elements not recited in any one of the independent claims that define the most generic concept of the present disclosure are described as arbitrary constituent elements.

Figure 1:
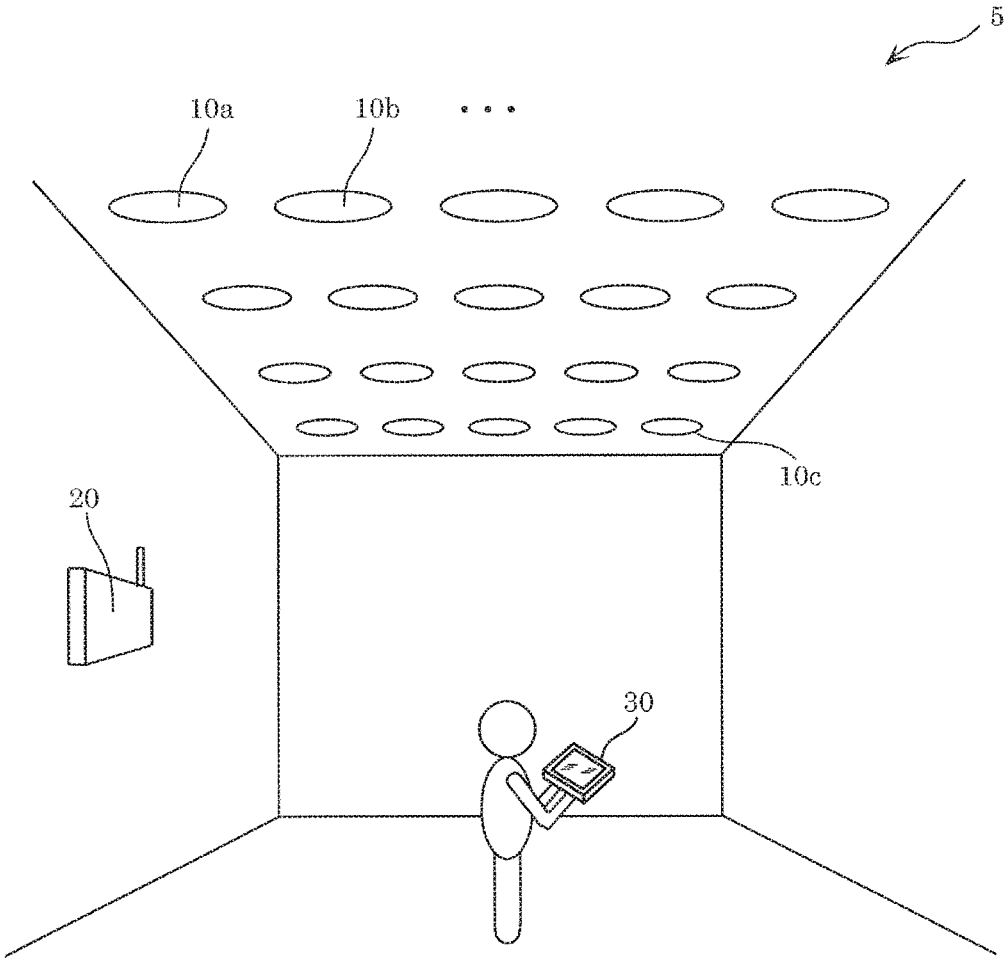
FIG. 1 is a schematic configuration diagram illustrating a main configuration of a lighting system according to an embodiment.

FIG. 1 is a schematic diagram illustrating a main configuration of lighting system 5 according to an embodiment. Lighting system 5 is capable of completing mapping of lighting devices easily and securely, and includes a plurality of lighting devices 10*a* to 10*c*, lighting commanding device 20, and terminal 30 as main constituent elements. It is to be noted that the result of mapping is stored in lighting commanding device 20 in this embodiment.

The plurality of lighting devices 10*a* to 10*c* are devices which emit light, and are, for example, downlights installed discretely in a room.

Terminal 30 is a terminal for controlling the plurality of lighting devices 10*a* to 10*c* by transmitting a control command to lighting devices 10*a* to 10*c*. Terminal 30 is, for example, a mobile information terminal such as a tablet terminal, and a smartphone.

Lighting commanding device 20 is a controller which relays the control command from terminal 30 to lighting devices 10*a* to 10*c*. Lighting commanding device 20 is, for example, disposed on a wall in a room or a ceiling, or included in any of lighting devices 10*a* to 10*c*.

Figure 2:
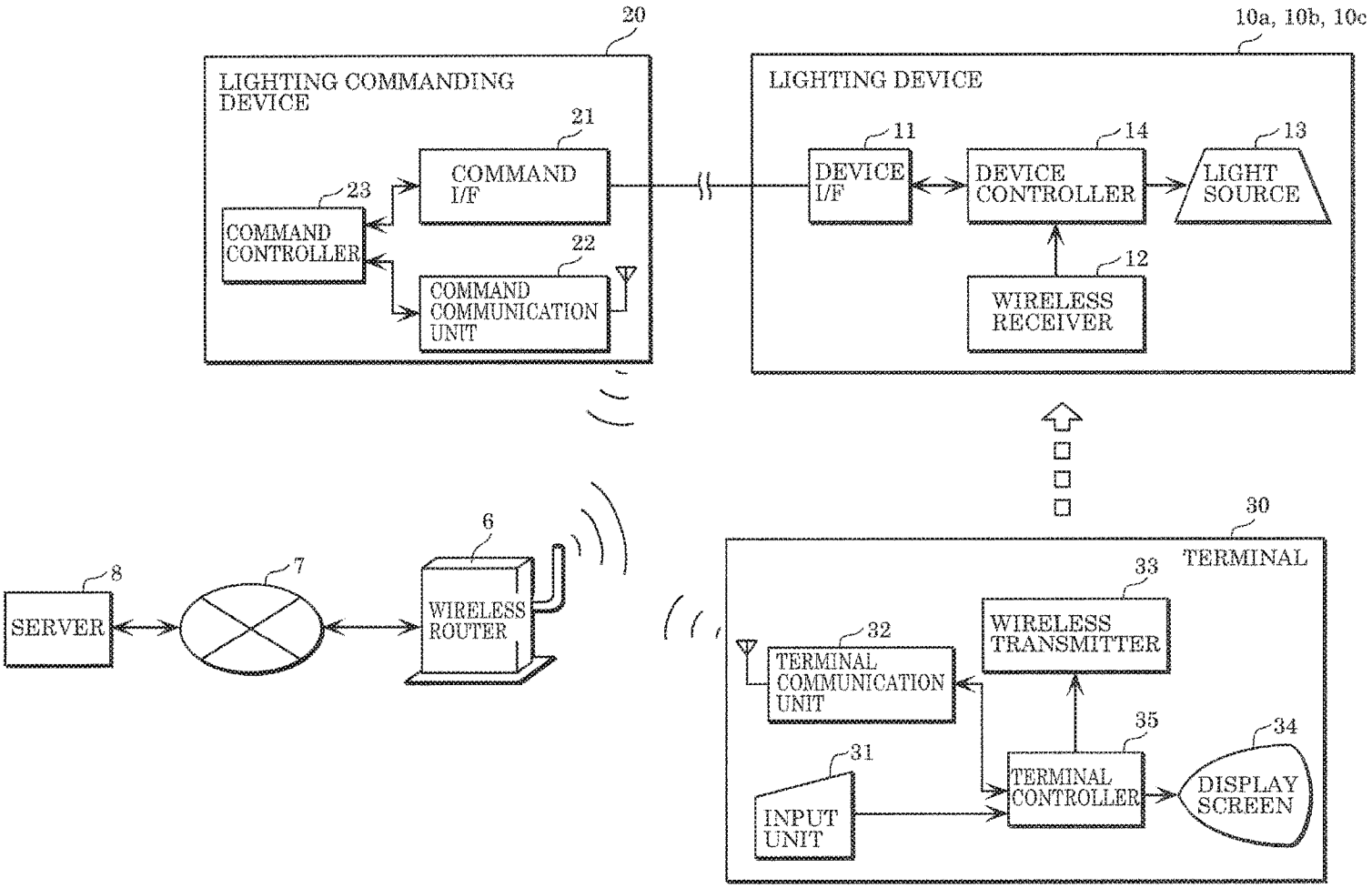
FIG. 2 is a block diagram illustrating configurations of a lighting device, a lighting commanding device, and a terminal which are included in the lighting system illustrated in FIG. 1.

FIG. 2 is a block diagram illustrating configurations of lighting devices 10*a* to 10*c*, lighting commanding device 20, and terminal 30 which are included in lighting system 5 illustrated in FIG. 1. Each of the plurality of lighting devices 10*a* to 10*c* has the same configuration, and thus it is to be noted that only one of the lighting devices is illustrated in the diagram. The diagram also illustrates, wireless router 6, Internet 7, and server 8 which are incidental constituent elements of lighting system 5.

Each of lighting devices 10*a* to 10*c* includes device interface (I/F) 11, wireless receiver 12, light source 13, and device controller 14.

Device I/F 11 is an interface fir communicating with lighting commanding device 20 wired or wirelessly (wired in this embodiment). Device I/F 11 is, for example, a serial communication interface, a wireless LAN communication interface, or the like.

Wireless receiver 12 is a receiver which receives a radio signal (an infrared ray signal in this embodiment) which is transmitted from wireless transmitter 33 of terminal 30, and is, for example, an infrared ray receiver.

Light source 13 is a light source which emits light, and is, for example, a light emitting diode (LED).

Device controller 14 is a controller which performs control through communication with device I/F 11, wireless receiver 12, and light source 13. Device controller 14 is, for example, a ROM for storing a control program, a processor for executing a control program, a RAM, a microcomputer (or a micro controller) having various kinds of input and output ports etc, or the like.

More specifically, when device controller 14 has received the infrared ray signal from terminal 30 as a process for mapping, device controller 14 performs an output operation indicating the reception of the infrared signal, and transmits the communication address of the lighting device to be used for communication with terminal 30. Here, the infrared ray signal has a predetermined data pattern, and may be fixed information or variable information specifying the output operation. The output operation is an operation which notifies the operator of the reception of the infrared ray signal. Examples include a sound output operation, an operation for transitioning to a predetermined lighting state, etc. (an operation for causing blinking light for a certain period of time in this embodiment).

It is to be noted that, in this embodiment, the infrared ray signal transmitted from wireless transmitter 33 of terminal 30 includes the logical address, device controller 14 transmits the communication address of the device itself together with the received logical address to lighting commanding device 20 via device I/F 11. In addition, in order to notify the operator of the fact that the logical address and the communication address have been successfully transmitted to lighting commanding device 20, device controller 14 controls lighting source 13 so as to create different lighting states before and after the transmission of the logical address and the communication address. For example, device controller 14 causes light source 13 to transition from a blinking state to a turn-off state. The paired logical address and communication address may be transmitted to terminal 30 directly or via lighting commanding device 20.

When device controller 14 has received a control command specifying the communication address of the device itself from lighting commanding device 20 via device I/F 11 for lighting control after mapping, device controller 14 performs turn-on, turn-off, dimming, or color adjustment by controlling light source 13 according to the control command.

Lighting commanding device 20 includes command I/F 21, command communicating unit 22, and command controller 23.

Command 21 is an interface for communicating with lighting devices 10*a* to 10*c* wired or wirelessly (wired in this embodiment). Command I/F 21 is, for example, a serial communication interface, a wireless LAN communication interface, or the like.

Command communication unit 22 is an interface which communicates with terminal 30 wirelessly (via wireless router 6 in this embodiment), and is, for example, a wireless LAN interface.

Command controller 23 is a controller which performs control with command I/F 21 and command communication unit 22. Command controller 23 is, for example, a ROM for storing a control program, a processor for executing a control program, a RAM, a microcomputer (or a micro controller) having various kinds of input and output ports etc, or the like.

More specifically, upon receiving the logical address transmitted from lighting devices 10*a* to 10*c* and the communication address via command 1/F 21, command controller 23 stores the received logical address and the communication address in an associated mariner, and performs device mapping. In addition, in lighting control, upon receiving the logical address and the control command transmitted from terminal 30 via wireless router 6 and command communication unit 22, command controller 23 identifies the communication address corresponding to the received logical address with reference to the result of the device mapping. Next, command controller 23 controls lighting devices 10*a* to 10*c* by transmitting the control command to the lighting device having the identified communication address via command I/F 21.

Wireless router 6 is a device having a function for relaying wireless communication between lighting commanding device 20 and terminal 30 and a function as a gateway which connects terminal 30 and a communication device (server 8 here) on Internet 7.

Figure 3A:
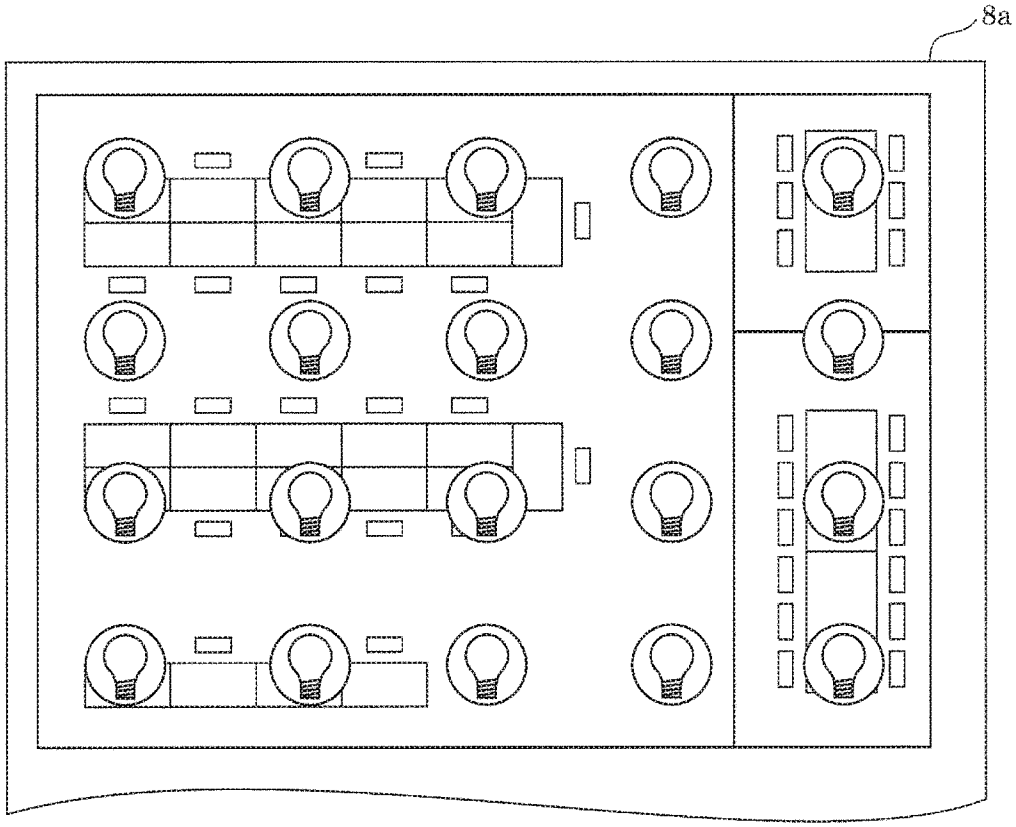
FIG. 3A is a diagram illustrating an example of arrangement information stored in a server illustrated in FIG. 1.

Server 8 is a communication device on Internet 7, and in this embodiment, is a device for providing arrangement information and order information of lighting devices 10*a* to 10*c* to terminal 30. Here, arrangement information is information of arrangement positions (in a room) of lighting devices 10*a* to 10*c*. For example, arrangement information is a drawing in which marks (images of electric bulbs enclosed by circles here) corresponding to lighting devices 10*a* to 10*c*, like arrangement information 8*a* illustrated in FIG. 3A). In FIG. 3A, marks corresponding to lighting devices 10*a* to 10*c* are drawn in a layout drawing of a room in which furniture items such as a desk are arranged. In addition, the order information is information indicating a mapping order of lighting devices 10*a* to 10*c*. For example, the order information is information including numbers sequentially specifying the lighting devices arranged adjacent to each other, like order information 8*b* illustrated in FIG. 3B. In order information 8*b* illustrated in FIG. 3B, the numbers indicating the mapping order are written at parts corresponding to the arrangement positions of the respective lighting devices in arrangement information 8*a* illustrated in FIG. 3A. It is to be noted that arrangement information 8*a* and order information 8*b* are typically created by a lighting designer in advance at a stage before the arrangement of lighting devices 10*a* to 10*c*.

Terminal 30 includes input unit 31, terminal communication unit 32, wireless transmitter 33, display screen 34, and terminal controller 35.

Input unit 31 is a device which receives an instruction from an operator, and is, for example, a touch panel, a button, or the like.

Wireless transmitter 33 is a communication interface which transmits a radio signal having a directivity. Wireless transmitter 33 is, for example, a device which transmits visible light or infrared rays as a radio signal (an infrared ray transmitting device mounted onto terminal 30 in a detachable manner in this embodiment). Wireless transmitter 33 transmits a (beam-shaped) radio signal having a directivity, so that the radio signal is directed only to a single lighting device which is a target for mapping.

Terminal communication unit 32 is a communication interface which wirelessly transmits a control command to at least one of lighting devices 10*a* to 10*c* specifying a communication address and the logical address corresponding to the communication address. Terminal communication unit 32 is, for example, a wireless LAN communication interface. It is to be noted that when terminal 30 stores the result of the mapping and can refer to the result of the mapping, terminal 30 transmits the control command specifying the "communication address". In this case, terminal 30 converts the logical address to a communication address, and transmits the converted communication address to lighting devices 10*a* to 10*c*. On the other hand, when the result of mapping is stored outside (that is, in lighting commanding device 20) terminal 30 as in this embodiment, terminal 30 transmits the control command specifying the "logical address". In this case, the logical address transmitted from terminal 30 is converted to the communication address by lighting commanding device 20, and the converted communication address is transmitted to lighting devices 10*a* to 10*c*.

Display screen 34 is a display which displays various kinds of information for interacting with the operator, and is a liquid crystal display (LCD).

Terminal controller 35 is a controller which performs control through communication with input unit 31, terminal communication unit 32, wireless transmitter 33, and display screen 34. Terminal controller 35 is, for example, a ROM for storing a control program, a processor for executing a control program, a RAM, a microcomputer (or a micro controller) having various kinds of put and output ports etc., or the like.

More specifically, for mapping, terminal controller 35 displays, on display screen 34, a plurality of icons respectively corresponding to lighting devices 10*a* to 10*c*. When an instruction for selecting any one of the plurality of icons displayed on display screen 34 has been received, terminal controller 35 causes wireless transmitter 33 to transmit a radio signal indicating predetermined information. In this embodiment, terminal controller 35 causes wireless transmitter 33 to transmit an infrared ray signal indicating the logical address corresponding to the selected icon as a radio signal indicating the predetermined information. Subsequently, when controlling the lighting device corresponding to the icon selected from among the plurality of icons is controlled after the completion of the mapping, terminal controller 35 transmits the logical address corresponding to the selected icon and the control command to lighting commanding device 20. Lighting commanding device 20 converts the received logical addresses to communication addresses, and transmits the control command to the lighting devices each having the converted communication address, so as to control the lighting devices corresponding to the received logical addresses.

Here, in order to help the operator to perform the mapping operation easily and securely, terminal controller 35 displays, on display screen 34, the icons corresponding to the plurality of lighting devices 10*a* to 10*c* and also images for helping the operator to select the plurality of icons in a predetermined order. These images are, for example, images showing the numerals indicating the order positions and respectively displayed near the plurality of icons (hereinafter, these images are referred to as "order position images". In addition, terminal controller 35 obtains, as the predetermined order, arrangement information indicating arrangement positions of lighting devices 10*a* to 10*c*, from outside (server 8 here) terminal 30, and determines the order positions of lighting devices 10*a* to 10*c* according to the arrangement positions, with reference to the obtained arrangement information. The arrangement information is, for example, arrangement information 8*a* as illustrated in FIG. 3A. In addition, the order positions according to the arrangement positions of lighting devices 10*a* to 10*c* are, for example, order positions (arrangement positions of lighting devices 10*a* to 10*c*) sequentially specifying the lighting devices arranged adjacent to each other. It is to be noted that terminal controller 35 is also capable of editing arrangement information according to an instruction from the operator received by input unit 31, and displaying the order position images showing the order positions according to the edited arrangement information.

Figure 3B:
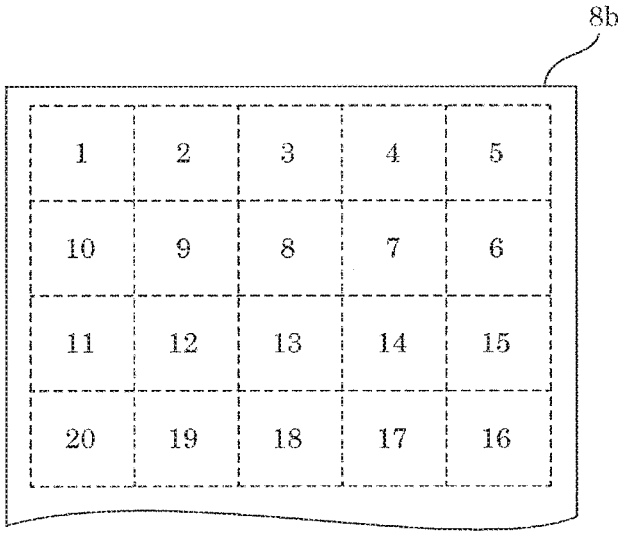
FIG. 3B is a diagram illustrating an example of order information stored in the server illustrated in FIG. 1.

In this embodiment, as for the generation of order position images, terminal controller 35 obtains order information indicating a predetermined order from outside (server 8 here) terminal 30, generates order position images each showing a position in the order indicated by the obtained order information, and displays the order position images on the display screen. The order information is, for example, order information 8*b* as illustrated in FIG. 3B.

Next, descriptions are given of operations of lighting system 5 in this embodiment configured as described above.

Figure 4A:
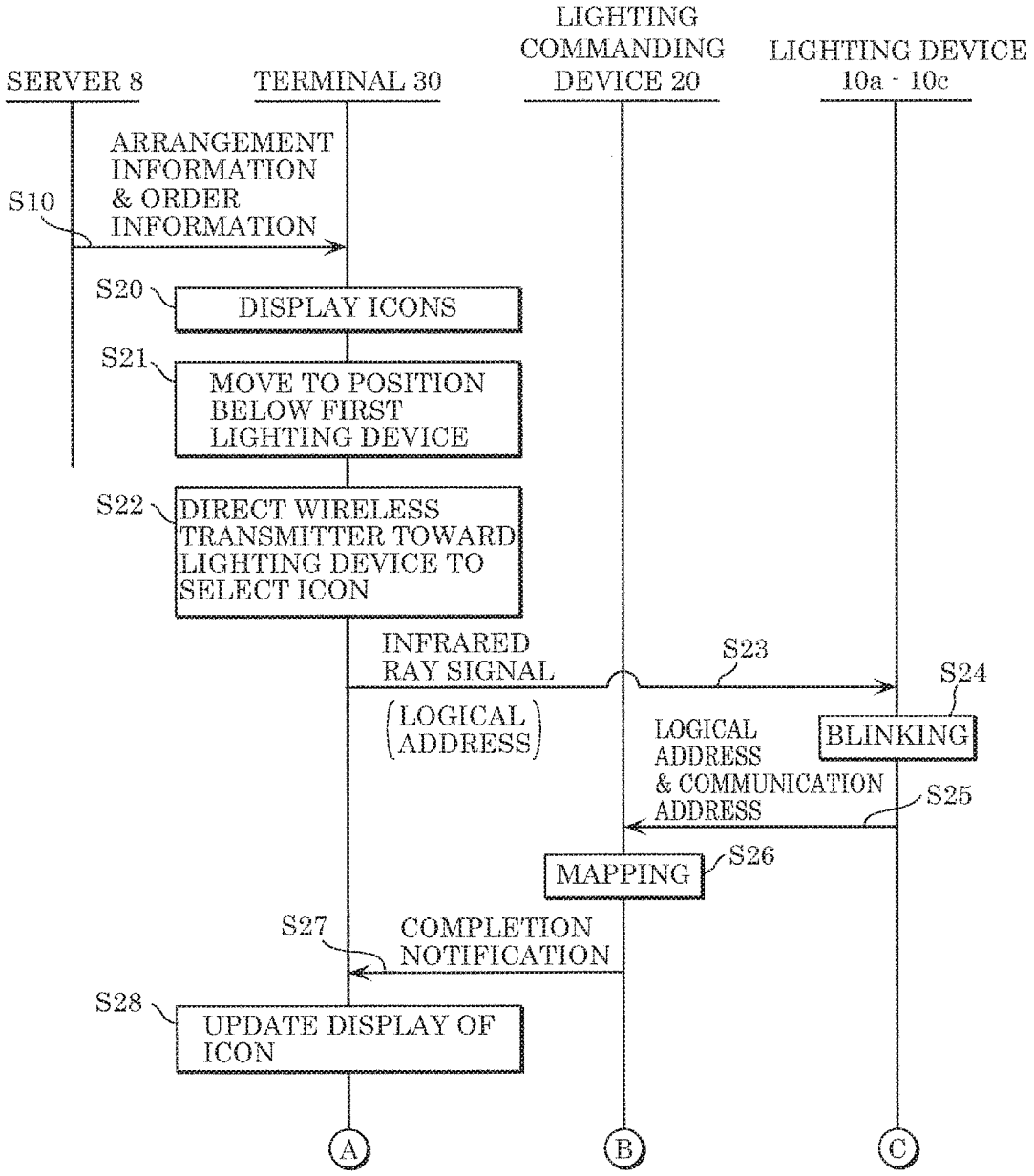
FIG. 4A is a sequence diagram illustrating operations of the lighting system according to the embodiment.
Figure 4B:
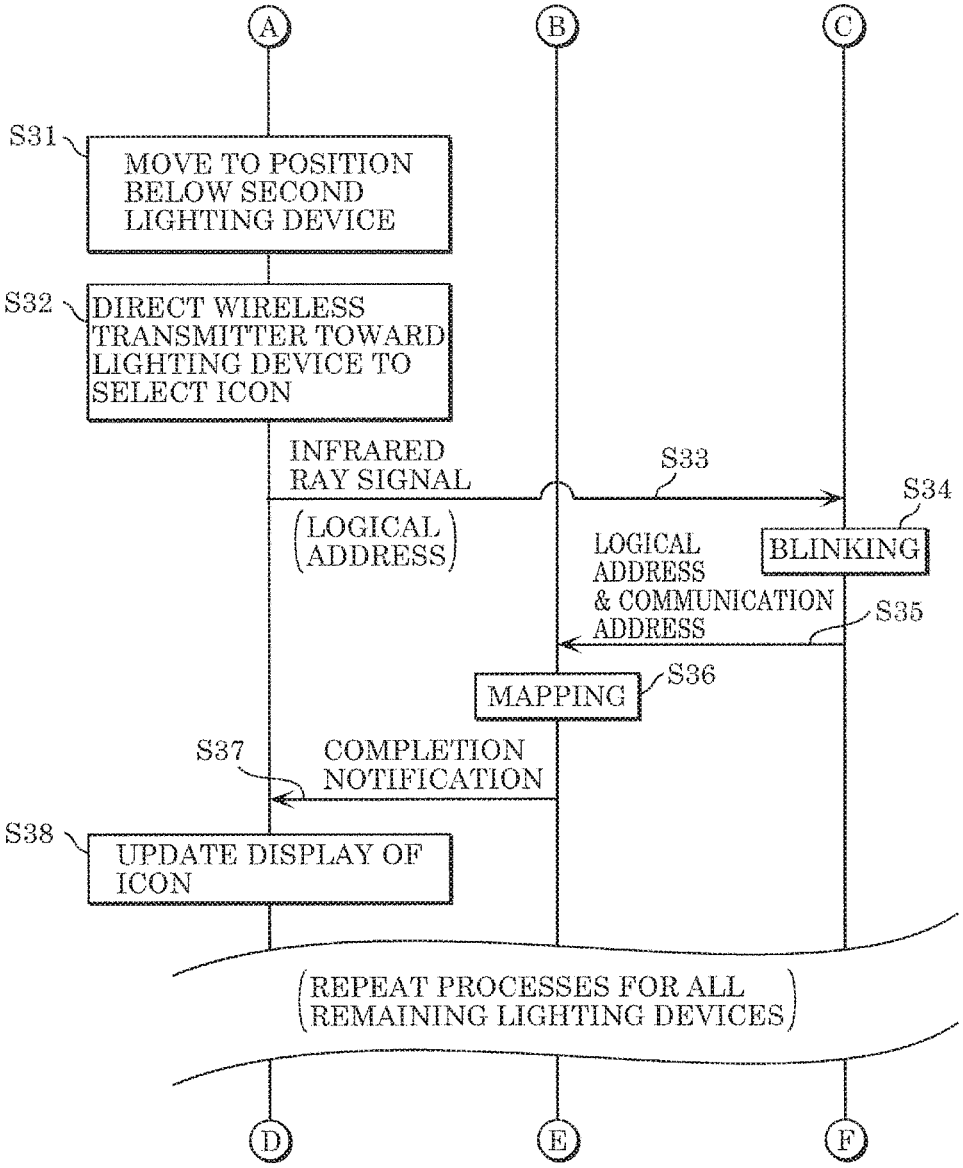
FIG. 4B is a sequence diagram (subsequent to the above sequence diagram) illustrating operations of the lighting system according to the embodiment.
Figure 4C:
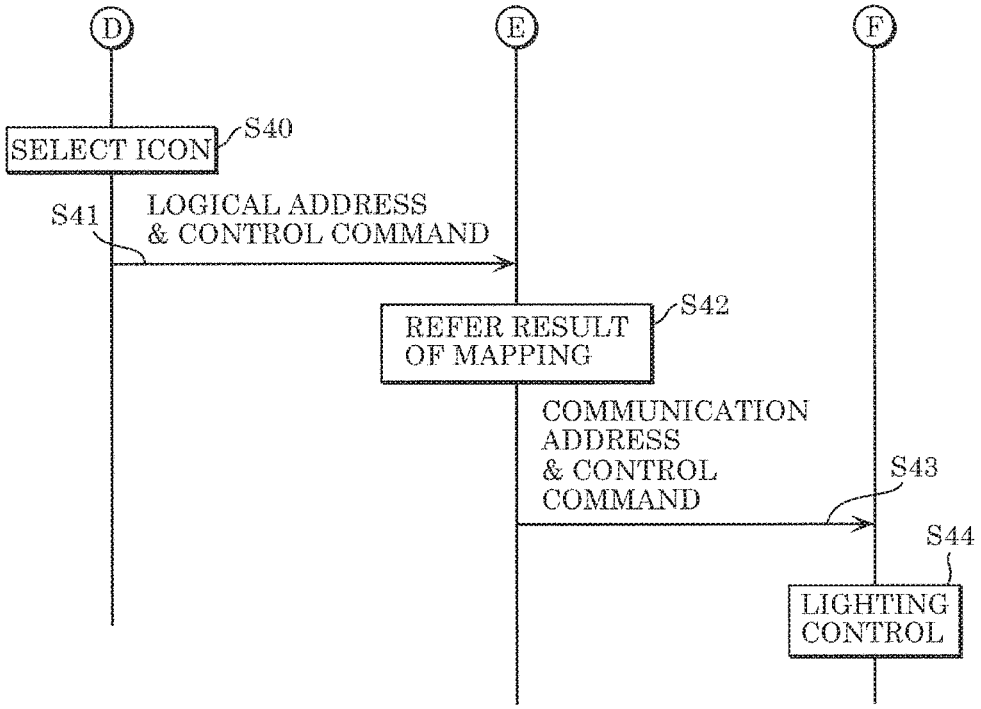
FIG. 4C is a sequence diagram (subsequent to the above sequence diagram) illustrating operations of the lighting system according to the embodiment.

Each of FIG. 4A to 4C is a sequence diagram indicating operations of lighting system 5 in this embodiment. Each of FIG. 4A to 4C illustrates operation and communication procedures performed by server 8, terminal 30, lighting commanding device 20, and lighting devices 10*a* to 10*c*, as for mapping and control of lighting devices 10*a* to 10*c* after the mapping.

As illustrated in FIG. 4A, first, terminal controller 35 of terminal 30 obtains arrangement information and order information of lighting devices 10*a* to 10*c* from server 8 via Internet 7, wireless router 6, and terminal communication unit 32, as preparation for mapping (S10). For example, terminal controller 35 obtains arrangement information 8*a* illustrated in FIG. 3A and order information 8*b* illustrated in FIG. 3B, and stores them in internal memory.

Subsequently, terminal controller 35 displays, on display screen 34, a plurality of icons respectively corresponding to lighting devices 10*a* to 10*c* according to the obtained arrangement information, and displays, on display screen 34, the order position images according to the obtained order information (S20).

Figure 5:
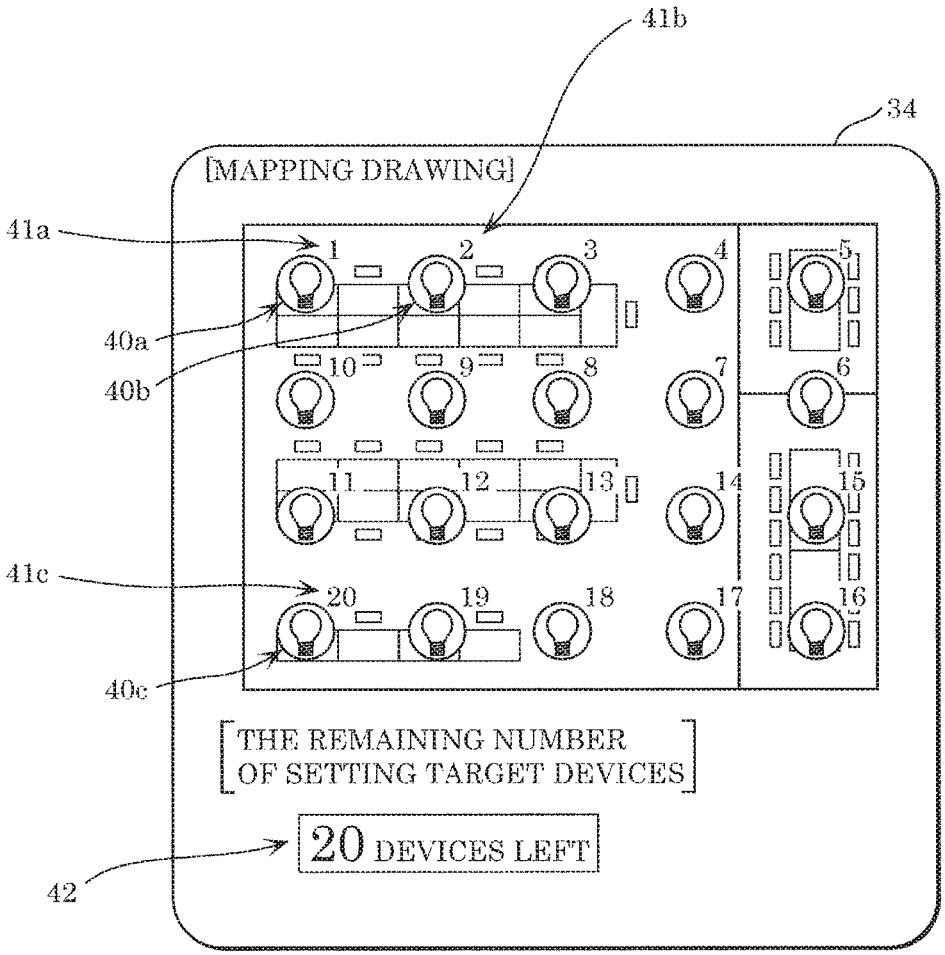
FIG. 5 illustrates a display example of a plurality of icons and images indicating the order positions of the icons on a display screen of a terminal.

FIG. 5 is a diagram illustrating a display example of the plurality of icons and order position images on display screen 34 of terminal 30. As illustrated in the diagram, twenty icons 40*a* to 40*c* each corresponding to one of lighting devices 10*a* to 10*c* are displayed on display screen 34. These images (including a layout) of icons 40*a* to 40*c* correspond to images indicated by the arrangement information (an image) obtained from server 8. The arrangement positions of these icons 40*a* to 40*c* correspond to the actual arrangement positions in a room.

In addition, order position images 41*a* to 41*c* indicating the mapping order positions recommended to the operator are displayed near respectively corresponding icons 40*a* to 40*c* (at the upper right of bulb images in this embodiment). Order position images 41*a* to 41*c* are images showing the numerals assigned according to the positions in the order indicated by the order information obtained from server 8. Here, the numerals have been assigned in the order in which the lighting devices arranged adjacent to each other are specified sequentially (the order from left end to right end in the first row and from right end to left end in the second row, and this order is repeated for the following rows).

In addition, in the display example in the diagram, the number of icons for which mapping has not yet been completed (that is, the number of lighting devices for which mapping has not yet been completed) is displayed as being "DEVICES LEFT" 42 as "THE REMAINING NUMBER OF SETTING TARGET DEVICES".

Returning to FIG. 4A again, in order to perform mapping of a firstly-handled lighting device, the operator firstly holds terminal 30 and moves to a position below the firstly-handled lighting device (hereinafter referred to as lighting device 10*a*) corresponding to the icon assigned with numeral "1" (S21). Subsequently, the operator selects an icon (by, for example, touching the icon) assigned with numeral "1" on display screen 34 in a state where the operator holds terminal 30 so as to direct wireless transmitter 33 of terminal 30 toward lighting device 10*a* corresponding to numeral "1" (S22).

Figure 6:
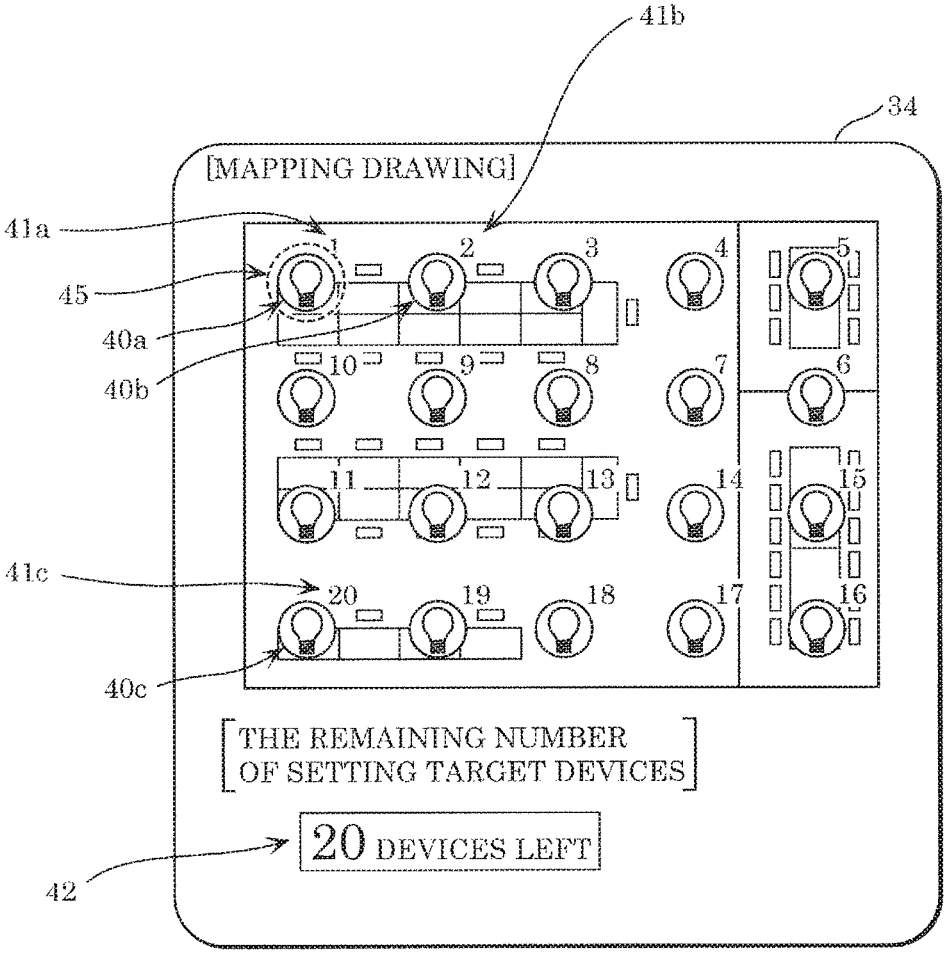
FIG. 6 illustrates a display example of the display screen of the terminal when one of the plurality of icons is selected.

FIG. 6 is a diagram illustrating a display example of display screen 34 when one of the plurality of icons is selected. Here, the icon assigned with numeral "1" has been selected, broken-line circular frame 45 enclosing the icon is displayed, so as to indicate that the icon has been selected.

Figure 7:
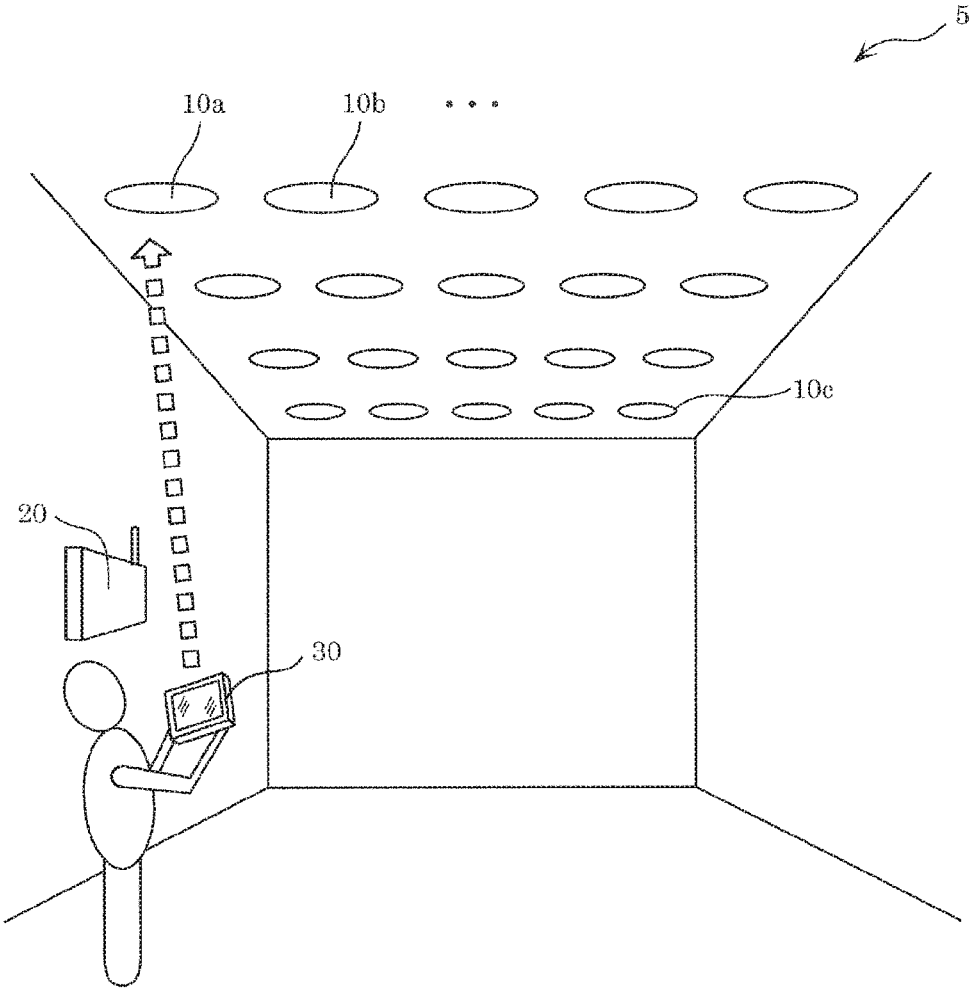
FIG. 7 is a diagram illustrating a scene in which an infrared ray signal indicating the logical address of a lighting device which is a mapping target is transmitted from a wireless transmitter of the terminal to the target lighting device.

Returning to FIG. 4A again, upon the selection on the icon, terminal controller 35 transmits, from wireless transmitter 33, an infrared ray signal indicating the logical address predetermined corresponding to the selected location in the map and stored (S23). FIG. 7 is a diagram illustrating a scene in which an infrared ray signal indicating the logical address of lighting device 10*a* which is a mapping target is transmitted from wireless transmitter 33 of terminal 30 to lighting device 10*a*. This scene is created because the operator has selected the icon on display screen 34 at the position below lighting device 10*a*. In this embodiment, a beam of the infrared ray signal which includes numeral "1" assigned to the selected icon is transmitted from wireless transmitter 33 to lighting device 10*a* as the logical address of lighting device 10*a*.

Returning to FIG. 4A again, in lighting device 10*a* which has received the infrared ray signal including the logical address using wireless receiver 12, device controller 14 performs an output operation (an operation for creating blinking light for a certain period of time, in this embodiment) indicating the reception of the infrared ray signal (S24). In this way, the operator knows that the infrared ray signal for mapping has reached lighting device 10*a* corresponding to numeral "1". Subsequently, device controller 14 transmits the communication address of the device itself to lighting commanding device 20 together with the received logical address via device I/F 11 (S25).

In lighting commanding device 20 which has received the logical address and the communication address transmitted from lighting device 10*a* via command I/F 21, command controller 23 stores the received logical address and communication address in internal memory in an associated manner (S26). In this way, mapping of firstly-handled lighting device 10*a* is completed. Subsequently, command controller 23 notifies terminal 30 of the completion of the mapping of firstly-handled lighting device 10*a* (completion information including the logical address of lighting device 10*a*) via command communication unit 22 (S27).

Terminal 30 which has received the completion notification of mapping including the logical address of lighting device 10*a* from lighting commanding device 20, terminal controller 35 updates the display of an icon and the display showing the number of lighting devices for which mapping has not yet been completed on display screen 34 on which the plurality of icons are displayed (S28). More specifically, terminal controller 35 changes the display (changes the color, assigns a mark, changes the display luminance, or the like) to a state showing the completion of the mapping for the icon corresponding to the logical address for which the completion notification has been received. Subsequently, terminal controller 35 updates the number of lighting devices for which mapping has not yet been completed to a value Obtained by subtracting 1, and displays the value.

Figure 8:
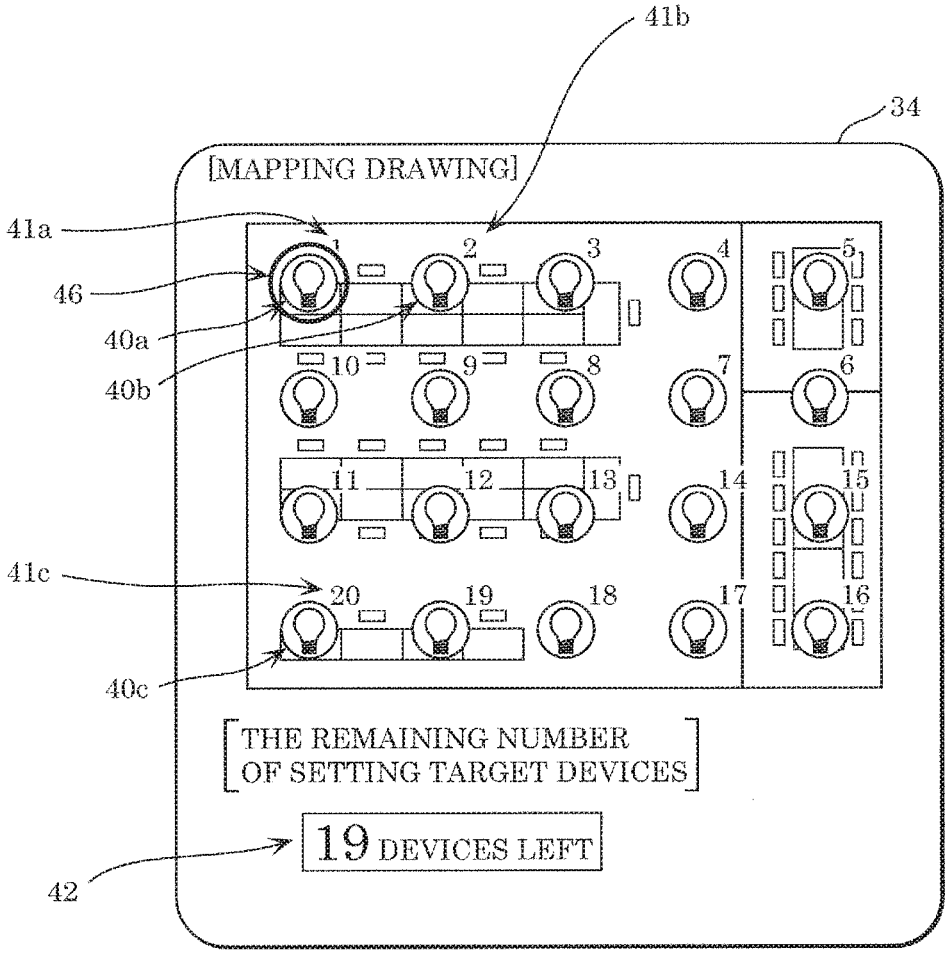
FIG. 8 is a diagram illustrating a display example on the display screen of the terminal which has received a mapping completion notification of one of the lighting devices.

FIG. 8 is a diagram illustrating a display example of display screen 34 of terminal 30 which has received the completion notification of the mapping of lighting device 10*a*. Here, bold-solid-line circular frame 46 enclosing the icon assigned with numeral "1" is displayed so as to indicate the completion of the mapping of lighting device 10*a* corresponding to the icon. In addition, the number of lighting devices for which mapping has not yet been completed is updated to "19" (as the remaining number of setting target devices denoted by 42), and "19" is displayed. With the display, the operator knows that the mapping of firstly-handled lighting device 10*a* has been completed.

Figure 9:
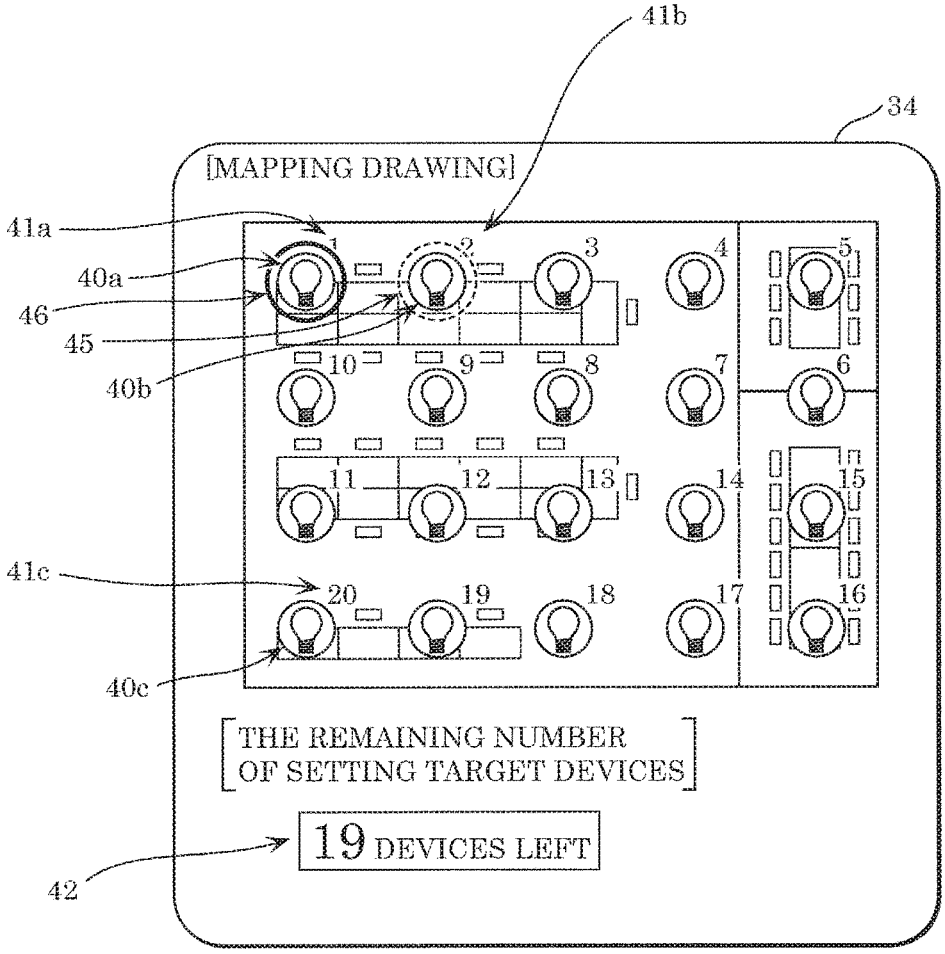
FIG. 9 is a diagram illustrating the display screen of the terminal when one of the plurality of icons has been selected.

Next, as illustrated in FIG. 4B, in order to perform mapping of a secondly-handled lighting device, the operator firstly holds terminal 30 and moves to a position below the secondly-handled lighting device (hereinafter referred to as lighting device 10*b*) corresponding to the icon assigned with numeral "2" (S31). Subsequently, the operator selects an icon (by, for example, touching the icon) assigned with numeral "2" on display screen 34 in a state where the operator holds terminal 30 so as to direct wireless transmitter 33 of terminal 30 to lighting device 10*a* corresponding to numeral "2" (S32). FIG. 9 is a diagram illustrating a display example of display screen 34 when one of the plurality of icons has been selected. Here, since the icon assigned with numeral "2" has been selected, broken-line circular frame 45 enclosing the icon is displayed so as to indicate that the icon has been selected.

Hereinafter, the processing is performed according to the same procedure as in the mapping of firstly-handled lighting device 10*a*, and the mapping of secondly-handled lighting device lob has been completed using lighting commanding device 20 (S33 to S37). Subsequently, terminal 30 which receives the completion notification from lighting commanding device 20 displays information indicating that the mapping of secondly-handled lighting device 10*b* has been completed (S38).

In this way, as for each of the icons of lighting devices 10*a* to 10*c* displayed on display screen 34, the operator moves to a position below a target lighting device specified by the position in the order indicated by an order position image assigned to the icon, and gives an instruction for selecting the icon. In this way, mapping of all lighting devices to 10*c* is completed.

When the mapping has been completed according to the above procedures, terminal 30 can specify the lighting devices arranged at the positions desired to be controlled and control lighting thereof, according to instructions from the operator, predetermined lighting scenes, lighting schedules, etc. It is to be noted that a lighting scene is information in which at least one of dimming and color adjustment is specified. A lighting schedule is information in which points of time and lighting scenes to be executed are associated with each other.

As illustrated in FIG. 4C, it is assumed now that an icon to be controlled has been selected from among the plurality of icons displayed on display screen 34 of terminal 30, and that control details (turn-on, turn-off, dimming, color adjustment, etc.) have been specified (S40). In response, terminal controller 35 transmits the logical address corresponding to the selected icon and a control command to lighting commanding device 20 (S41).

Lighting commanding device 20 which has received the notification of the logical address and the control command identifies the communication address corresponding to the logical address, with reference to the association by the mapping stored in the internal memory (S42). Subsequently, command controller 23 transmits the received control command to the lighting device having the identified communication address via command I/F 21 (S43).

In the lighting device which has received the control command specifying the communication address of the lighting device itself, device controller 14 perform lighting control (turn-on, turn-off, dimming, or color adjustment) by controlling light source 13 according to the received control command (S44).

It is to be noted that, as an alternative to a case where one of the plurality of icons displayed on display screen 34 is selected as for selection of lighting devices 10*a* to 10*c* which are targets of control by terminal 30, a plurality of icons may be selected or a group of icons may be selected. In such a case, terminal 30 transmits the same control command to the plurality of icons or the plurality of lighting devices corresponding to the icon selected as the group at the same time, so as to collectively control the lighting of the group of lighting devices. In addition, the instructions of control details may be determined according to predetermined lighting scenes or lighting schedules, as an alternative to the determination made by the operator for each time of control.

As described above, lighting system 5 according to this embodiment is a system including the plurality of lighting devices 10*a* to 10*c* and terminal 30 which controls lighting devices 10*a* to 10*c*. Terminal 30 includes display screen 34, input unit 31 which receives an instruction from the operator, wireless transmitter 33, and terminal controller 35. Wireless transmitter 33 transmits a radio signal having a directivity. Terminal communication unit 32 wirelessly transmits a control command to at least one of the plurality of lighting devices 10*a* to 10*c* specifying the communication address or the logical address thereof. Terminal controller 35 displays the plurality of icons respectively corresponding to the plurality of lighting devices 10*a* to 10*c* on display screen 34, and when an instruction for selecting any one of the plurality of icons has been received by input unit 31, causes wireless transmitter 33 to transmit a radio signal indicating predetermined information. When each of lighting devices 10*a* to 10*c* has received the radio signal transmitted from wireless transmitter 33, the lighting device transmits the communication address of the lighting device used for communication with terminal communication unit 32.

In this way, when any one of the plurality of icons has been selected, the radio signal having a directivity indicating predetermined information is transmitted from terminal 30, and the lighting device which has received the radio signal transmits the communication address of the lighting device itself. This makes it possible to perform mapping of the desired lighting device (which is the target to which the radio signal is emitted), by associating the logical address of the selected icon and the communication address transmitted from the lighting device. In other words, the operator can perform mapping in an order convenient for the operator (for example, in the arrangement order of the lighting devices). This eliminates the conventional need to move to positions near lighting devices which blink at random for check. As a result, the moving distance (that is a traffic line) in mapping is shorten. Furthermore, it is possible to proceed mapping in the order intended by the operator, and thus operation errors are reduced. As a result, it is possible to achieve the lighting system capable of completing mapping in the lighting system more easily and securely than conventional.

In addition, when each of lighting devices 10*a* to 10*c* has received the radio signal transmitted from wireless transmitter 33, the lighting device further performs an output operation indicating that the radio signal has been received. For example, the output operation is a light emitting operation performed by each of lighting devices 10*a* to 10*c* which has received the radio signal.

In this way, the operator can check by eyesight that the radio signal has reached the intended lighting device.

In addition, lighting system 5 further includes lighting commanding device 20 which controls the plurality of lighting devices 10*a* to 10*c* according to the control command from terminal 30. When an instruction for selecting any one of the plurality of icons has been received by input unit 31, terminal controller 35 causes wireless transmitter 33 to transmit the radio signal indicating the logical address corresponding to the selected icon as predetermined information. When each of the plurality of lighting devices 10*a* to 10*c* has received the radio signal transmitted from wireless transmitter 33, the lighting device transmits the communication address together with the logical address indicated by the received radio signal to lighting commanding device 20. Upon receiving the logical address and communication address transmitted from lighting devices 10*a* to 10*c*, lighting commanding device 20 performs mapping by storing the received logical address and communication address in an associated manner.

In this way, lighting commanding device 20 which has received the notification of the logical address and communication address from each of lighting devices 10*a* to 10*c* stores the association, and thereby manages storage, edition, reference, etc. in mapping.

In addition, when terminal controller 35 controls one of lighting devices 10*a* to 10*c* corresponding to the icon selected from among the plurality of icons, terminal controller 35 transmits the logical address corresponding to the selected icon and a control command to lighting commanding device 20. Upon receiving the logical address and control command transmitted from terminal device 30, lighting commanding device 20 identifies the communication address corresponding to the logical address with reference to the association by mapping, and transmits the control command to the one of lighting devices 10*a* to 10*c* having the identified communication address.

In this way, terminal 30 can controls lighting of the desired lighting device by transmitting the logical address of the lighting device desired to be controlled and the control command to lighting commanding device 20, without managing the communication addresses of lighting devices 10*a* to 10*c* in the terminal itself.

Furthermore, terminal controller 35 displays, on display screen 34, order position images for helping the operator to select the plurality of icons in a predetermined order.

In this way, the operator can finish mapping of all of lighting devices 10*a* to 10*c* by performing mapping in the displayed order. This reduces operation errors, and thus the operator can complete the mapping more securely.

In addition, terminal controller 35 obtains arrangement information indicating the arrangement positions of the plurality of lighting devices 10*a* to 10*c* from outside terminal 30, and displays order position images such that the order position images indicate an order according to the arrangement positions of the plurality of lighting devices 10*a* to 10*c* as the predetermined order. For example, the order according to the arrangement positions of the plurality of lighting devices 10*a* to 10*c* is the order sequentially specifying lighting devices 10*a* to 10*c* arranged adjacent to each other.

In this way, mapping can be performed in the actual arrangement order of lighting devices 10*a* to 10*c*. Thus, the distance (that is, a traffic line) by which the operator is required to move is reduced to a short distance.

In addition, terminal controller 35 edits arrangement information according to the instruction from the operator which has been received by input unit 31, and displays order position images such that the order position images indicate the order according to the edited arrangement information.

In this way, it is possible to perform mapping of lighting devices in the order convenient for the operator, which increases user friendliness in the mapping operations.

In addition, terminal controller 35 obtains the order information indicating the predetermined order from outside terminal 30, and displays the order position information on display screen 34 in the order indicated by the obtained order information.

In this way, the order information indicates the efficient mapping order designed by a lighting designer or the like. Thus, the operator can complete the mapping in short time securely by performing the mapping in the order.

In addition, terminal controller 35 displays the plurality of icons on display screen 34, such that icons for which mapping has been completed and icons for which mapping has not yet completed are distinguishable from each other.

In this way, the operator can know, on display screen 34, the lighting devices for which mapping has been completed and lighting devices for which mapping has not yet completed. This prevents an overlapping mapping operation performed on the same lighting device, unintended omission of a mapping operation, etc.

In addition, terminal controller 35 displays, on display screen 34, the number of icons for which mapping has not yet completed from among the plurality of icons.

In this way, the operator can know the remaining number of lighting devices which are mapping targets, which increases the user friendliness in the mapping operations.

In addition, wireless transmitter 33 transmits visible light or infrared rays as a radio signal.

This makes it easier to direct the visible light or infrared rays having a directivity toward the one of the lighting devices which is the mapping target. Thus, the operator can securely specify the lighting device in the mapping operation.

In addition, wireless transmitter is attached to terminal 30 in a detachable manner.

By attaching wireless transmitter 33 to terminal 30 only at the time of performing a mapping operation, and detaching wireless transmitter 33 from terminal 30 in normal use, the configuration and the weir ht of terminal 30 in the normal use is simplified and reduced, respectively.

In addition, each of the plurality of lighting devices 10*a* to 10*c* exhibits different lighting states before and after the transmission of the communication address of the lighting device.

In this way, the operator can check by eyesight the lighting devices which are mapping targets, and thus perform the mapping more securely.

Although there is lighting commanding device 20 which relays a control command between terminal 30 and each of lighting devices 10*a* to 10*c* is present in lighting system 5 according to an embodiment, it is to be noted that lighting commanding device 20 is not always required.

Figure 10A:
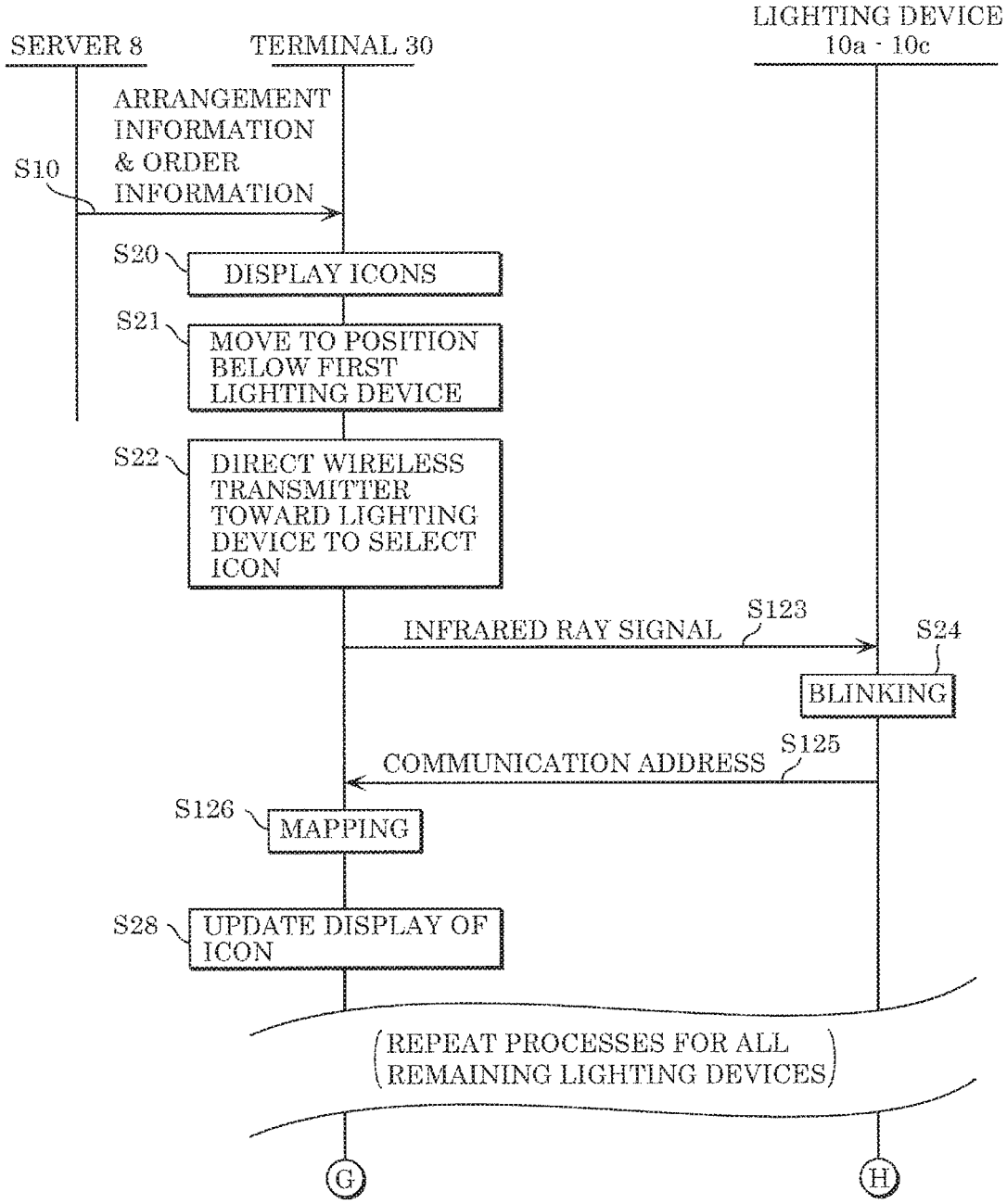
FIG. 10A is a sequence diagram indicating operations of a lighting system according to a variation of the embodiment.
Figure 10B:
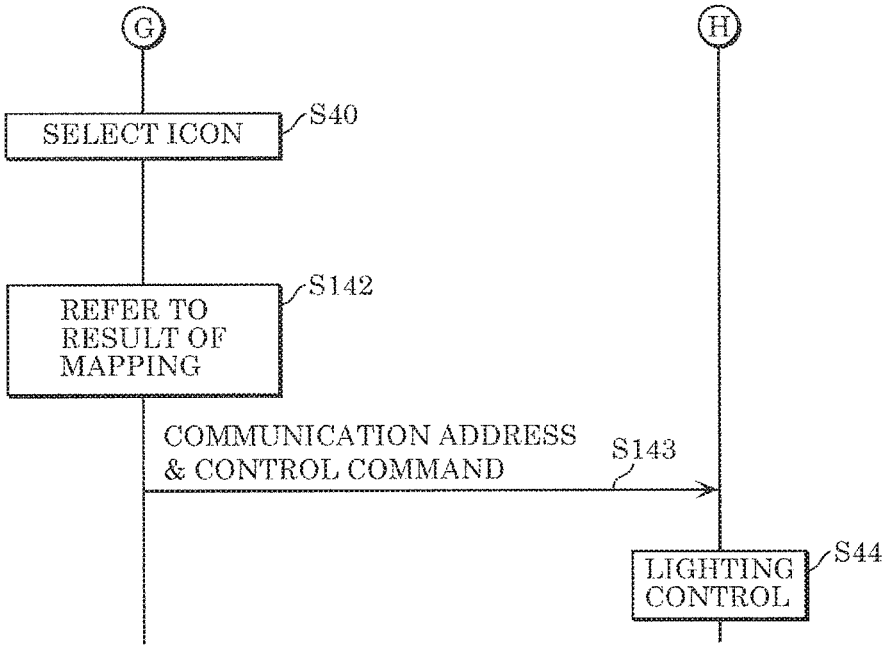
FIG. 10B is a sequence diagram (subsequent to the above sequence diagram) illustrating operations of the lighting system according to the variation of the embodiment.

Each of FIG. 10A and FIG. 10B is a sequence diagram indicating operations performed by a lighting system without any lighting commanding device according to a variation of the embodiment (in other words, a lighting system including lighting devices 10*a* to 10*c* and terminal 30). FIG. 10A illustrates a mapping procedure according to this variation. This procedure corresponds to the procedure illustrated in each of FIG. 4A and FIG. 4B in the above embodiment. FIG. 10B illustrates a lighting control procedure according to this variation. This procedure corresponds to the procedure illustrated in FIG. 4C in the above embodiment. In each of FIG. 10A and FIG. 10B, the same processes as in the sequence diagram illustrated in each of FIGS. 4A to 4C are assigned with the same reference signs as in FIGS. 4A to 4C, and different processes are assigned with different reference signs. Hereinafter, this variation is described mainly focusing on the processes different from those in FIGS. 4A to 4C.

As illustrated in FIG. 10A, in terminal 30 which has selected one of the icons, terminal controller 35 transmits an infrared ray signal indicating predetermined information from wireless transmitter 33 (S123). In the above embodiment, the infrared ray signal including the logical address corresponding to the selected icon has been transmitted. In this variation, instead, an infrared ray signal including predetermined information indicating a signal for mapping is transmitted.

Subsequently, in lighting device 10*a* which has received the infrared. ray signal, device controller 14 notifies terminal 30 of the communication address of the device itself in the form of a radio signal of visible light or infrared rays, or the like (S125), after performing an output operation for indicating the reception of the infrared ray signal (S24). In the above embodiment, the logical address and communication address have been notified to lighting commanding device 20. In this variation, however, only the communication address is notified to terminal 30.

Subsequently, in terminal 30 which has received the communication address transmitted from lighting device 10*a*, terminal controller 35 stores numeral "1" of the selected icon and the communication address which has been received just now in internal memory in association with each other. In this way, the mapping of lighting device 10*a* is completed (S126).

In addition, in lighting control after the completion of the mapping, as illustrated in FIG. 10B, terminal controller 35 identifies the communication address corresponding to the logical address of the lighting device corresponding to the selected icon, with reference to the association by the mapping (S142). Subsequently, terminal controller 35 transmits the control command (that is, the communication address and the control command) to the lighting device having the identified communication address via command I/F 21 (S143).

In this way, by means of terminal 30 having the functions (storing and referring to the result of mapping) instead of lighting commanding device 20 in the above embodiment, even the lighting system including lighting devices 10*a* to 10*c* and terminal 30 is capable of performing mapping and lighting control.

In this way, with the lighting system according to this variation, when each of the plurality of lighting devices 10*a* to 10*c* has received the radio signal transmitted from wireless transmitter 33, the lighting device transmits the communication address to terminal 30. Upon receiving the communication address transmitted from terminal 30, terminal controller 35 stores the received communication address in association with the icon selected from among the plurality of icons, and performs mapping thereof.

In this way, even the lighting system includes lighting devices 10*a* to 10*c* and terminal 30 but does not include any lighting commanding device 20 as in the above embodiment, terminal 30 performs mapping.

In addition, when terminal controller 35 controls one of lighting devices 10*a* to 10*c* corresponding to the icon selected from among the plurality of icons, terminal controller 35 identifies the communication address corresponding to the logical address of the one of lighting devices 10*a* to 10*c*, with reference to the association by the mapping, and causes terminal communication unit 32 to transmit the control command to the identified communication address.

In this way, even in the lighting system without lighting commanding device 20 as in the above embodiment, terminal 30 can directly control lighting devices 10*a* to 10*c* with reference to the result of mapping stored in terminal 30.

The lighting system, the lighting devices, and the terminal according to the present disclosure have been described based on the embodiment and variations above, but the present disclosure is not limited to the embodiment and variations. The present disclosure covers and encompasses embodiments that a person skilled in the art may arrive at by adding various kinds of modifications to the above embodiment or by arbitrarily combining some of the constituent elements in the embodiment within the scope of the present disclosure.

For example, in the above embodiment and variation, each of lighting devices 10*a* to 10*c* performs the output operation indicating the reception of the radio signal when the lighting device has received the radio signal transmitted from wireless transmitter 33 of terminal 30. However, the output operation does not always need to be performed. This is because the completion of the mapping of the target lighting device is reflected on the icon display in terminal 30, and thus the operator can know the fact that the radio signal has reached the lighting device without the output operation by the lighting device.

In addition, in the embodiment and variation, terminal 30 displays, on display screen 34, icons corresponding to lighting devices 10*a* to 10*c* and order position images indicating the order positions, based on arrangement information 8*a* and order information 8*b* obtained from server 8. However, terminal 30 does not always require the arrangement information and order information obtained from outside. Terminal 30 may arrange, on display screen 34, the plurality of icons corresponding to lighting devices 10*a* to 10*c* through a dialog with the operator, and may assign the plurality of icons with positions in a mapping order according to an instruction from the operator.

In addition, in the mapping, a radio signal transmitted from wireless transmitter 33 of terminal 30 may include the logical address or a control command for changing the lighting state of the lighting device in addition to the predetermined information. In addition, when each of lighting devices 10*a* to 10*c* has received the radio signal from terminal 30, the lighting device changes the lighting state according to the control command included in the radio signal. Thus, the operator can know the fact that the radio signal has reached the intended lighting device.

In addition, each of wireless transmitter 33 included in terminal 30 and wireless receiver 12 included in each of lighting devices 10*a* to 10*c* may be a communication device which transmits the radio signal of visible light, infrared rays, or the like. In this way, terminal 30 and each of lighting devices 10*a* to 10*c* can directly exchange information.

In addition, in the above embodiment, the positions in the mapping order are used as logical addresses of the lighting devices, but logical addresses are not limited thereto. Logical addresses may be names assigned arbitrarily to individual lighting devices or a group number assigned to a plurality of lighting devices, or the like.

While the foregoing has described one embodiment and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting system, comprising:

a plurality of lighting devices; and a terminal which controls the plurality of lighting devices, wherein the terminal includes:

a display screen;

an input unit configured to receive an instruction from an operator;

a wireless transmitter which transmits a radio signal having a directivity;

a communication unit configured to wirelessly transmit a control command to at least one of the plurality of lighting devices, specifying one of the communication address and the logical address; and a controller which displays, on the display screen, a plurality of icons respectively corresponding to the plurality of lighting devices, and when an instruction for selecting one of the plurality of icons has been received by the input unit, causes the wireless transmitter to transmit a radio signal indicating predetermined information, wherein:

when a lighting device among the plurality of lighting devices, which corresponds to the selected one of the plurality of icons has received the radio signal transmitted from the wireless transmitter, the lighting device transmits the communication address assigned to the lighting device to be used for communication with the communication unit, when each of the plurality of lighting devices has received the radio signal transmitted from the wireless transmitter, the lighting device transmits the communication address to the terminal, and upon receiving the communication address transmitted from the terminal, the controller performs mapping by storing the received communication address in association with an icon selected from among the plurality of icons.

2. The lighting system according to claim 1, wherein when the lighting device has received the radio signal transmitted from the wireless transmitter, the lighting device further performs an output operation which indicates the reception of the radio signal.

3. The lighting system according to claim 2, wherein the output operation is an operation to emit light performed by the lighting device upon receiving the radio signal.

4. The lighting system according to claim 1, wherein when the controller controls the lighting device corresponding to the selected icon, the controller identifies the communication address corresponding to the logical address of the lighting device with reference to association by the mapping, and causes the communication unit to transmit the control command to the identified communication address.

5. The lighting system according to claim 1, further comprising a lighting commanding device which controls the plurality of lighting devices according to a control command from the terminal, wherein when an instruction for selecting one of the plurality of icons has been received by the input unit, the controller causes the wireless transmitter to transmit a radio signal indicating a logical address corresponding to the selected icon as the predetermined information, when the lighting device has received the radio signal transmitted from the wireless transmitter, the lighting device transmits the communication address to the lighting commanding device together with the logical address indicated by the received radio signal, and when the lighting commanding device has received the logical address and the communication address transmitted from the lighting device, the lighting commanding device performs mapping by storing the logical address and the communication address received.

6. The lighting system according to claim 5, wherein when the controller controls the lighting device corresponding to the selected icon, the controller transmits the logical address corresponding to the selected icon and a control command to the lighting commanding device, and upon receiving the logical address and the control command transmitted from the terminal device, the lighting commanding device identifies the communication address corresponding to the logical address with reference to the association by the mapping, and transmits the control command to the lighting device having the identified communication address.

7. The lighting system according to claim 1,
wherein the controller displays, on the display screen, an image for guiding the operator to select the plurality of icons according to a predetermined order.

8. The lighting system according to claim 7,
wherein the controller obtains arrangement information indicating arrangement positions of the plurality of lighting devices from outside the terminal, and displays the image with reference to the obtained arrangement information, such that an order according to the arrangement positions of the plurality of lighting devices are indicated as the predetermined order.

9. The lighting system according to claim 8,
wherein the order according to the arrangement positions of the plurality of lighting devices is an order which sequentially specifies the lighting devices arranged adjacent to each other.

10. The lighting system according to claim 8,
wherein the controller edits the arrangement information according to the instruction from the operator received by the input unit, and displays the image such that an order according to the edited arrangement information is indicated.

11. The lighting system according to claim 7,
wherein the controller obtains order information indicating the predetermined order from outside the terminal, and displays the image on the display screen in the order indicated by the obtained order information.

12. The lighting system according to claim 1,
wherein the controller displays the plurality of icons on the display screen such that icons for which the mapping has been completed and icons for which the mapping has not yet been completed are distinguishable from each other.

13. The lighting system according to claim 1,
wherein the controller displays, on the display screen, the number of icons for which the mapping has not yet been completed from among the plurality of icons.

14. The lighting system according to claim 1,
wherein the wireless transmitter transmits visible light or infrared rays as the radio signal.

15. The lighting system according to claim 1,
wherein the wireless transmitter is attached to the terminal in a detachable manner.

16. The lighting system according to claim 1,
wherein each of the plurality of lighting devices exhibits different lighting states before and after transmitting the communication address of the lighting device itself.

17. A lighting device in a lighting system which includes:
a plurality of lighting devices including the lighting device; and
a terminal which controls the plurality of lighting devices,
wherein the terminal includes:
a display screen;
an input unit configured to receive an instruction from an operator;
a wireless transmitter which transmits a radio signal having a directivity;
a communication unit configured to wirelessly transmit a control command to at least one of the plurality of lighting devices, specifying one of the communication address and the logical address; and
a controller which displays, on the display screen, a plurality of icons respectively corresponding to the plurality of lighting devices, and when an instruction for selecting one of the plurality of icons has been received by the input unit, causes the wireless transmitter to transmit a radio signal indicating predetermined information, wherein:
when a lighting device among the plurality of lighting devices, which corresponds to the selected one of the plurality of icons has received the radio signal transmitted from the wireless transmitter, the lighting device transmits the communication address assigned to the lighting device to be used for communication with the communication unit,
when each of the plurality of lighting devices has received the radio signal transmitted from the wireless transmitter, the lighting device transmits the communication address to the terminal, and
upon receiving the communication address transmitted from the terminal, the controller performs mapping by storing the received communication address in association with an icon selected from among the plurality of icons.

18. A terminal in a lighting system which includes:
a plurality of lighting devices; and
the terminal which controls the plurality of lighting devices,
wherein the terminal includes:
a display screen;
an input unit configured to receive an instruction from an operator;
a wireless transmitter which transmits a radio signal having a directivity;
a communication unit configured to wirelessly transmit a control command to at least one of the plurality of lighting devices, specifying one of the communication address and the logical address; and
a controller which displays, on the display screen, a plurality of icons respectively corresponding to the plurality of lighting devices, and when an instruction for selecting one of the plurality of icons has been received by the input unit, causes the wireless transmitter to transmit a radio signal indicating predetermined information, wherein;
when a lighting device among the plurality of lighting devices, which corresponds to the selected one of the plurality of icons has received the radio signal transmitted from the wireless transmitter, the lighting device transmits the communication address assigned to the lighting device to be used for communication with the communication unit,
when each of the plurality of lighting devices has received the radio signal transmitted from the wireless transmitter, the lighting device transmits the communication address to the terminal, and
upon receiving the communication address transmitted from the terminal, the controller performs mapping by storing the received communication address in association with an icon selected from among the plurality of icons.

* * * * *